US005865198A

United States Patent [19]

Hartman

[11] Patent Number: 5,865,198

[45] Date of Patent: Feb. 2, 1999

[54] REFRIGERATED VAPOR DEGREASING SYSTEM

[76] Inventor: Albert V. Hartman, 511 W. Sunrise Ln., Boyertown, Pa. 19512

[21] Appl. No.: 855,822

[22] Filed: May 12, 1997

[51] Int. Cl.[6] ..... B08B 3/10

[52] U.S. Cl. ..... 134/56 R; 134/58 R; 134/105; 134/108

[58] Field of Search ..... 134/105, 108, 134/21, 56 R, 57 R, 58 R, 184, 186; 34/73; 68/18 C

[56] References Cited

U.S. PATENT DOCUMENTS

| | | | |
|---|---|---|---|
| 4,390,396 | 6/1983 | Koblenzer . | |
| 4,537,660 | 8/1985 | McCord . | |
| 5,327,920 | 7/1994 | Gerard et al. | 134/57 R |
| 5,417,769 | 5/1995 | Gerard et al. | 134/105 |
| 5,454,390 | 10/1995 | Lawson et al. | 134/105 |
| 5,469,876 | 11/1995 | Gray et al. | 134/105 |
| 5,492,138 | 2/1996 | Taricco | 134/105 |

FOREIGN PATENT DOCUMENTS 2075067 11/1981 United Kingdom .

OTHER PUBLICATIONS

European Patent Office 241,749 134/105, Oct. 1987.

*Primary Examiner*—Frankie L. Stinson

*Attorney, Agent, or Firm*—John F. A. Earley; John F. A. Earley, III; Harding, Earley, Follmer & Frailey

[57] ABSTRACT

A refrigerated vapor degreasing system for cleaning workpieces. The system has a tank for containing a bath of degreasing solvent, a heater for vaporizing the solvent, a primary solvent condenser, a secondary solvent condenser, and a single refrigeration unit which can be switched to operate in two different modes. The primary solvent condenser creates a degreasing zone above the solvent bath around work pieces supported therein and creates a primary barrier preventing the vaporized solvent from escaping the tank. The secondary solvent condenser creates a cold air blanket above the degreasing zone which acts as a secondary barrier preventing the vaporized solvent from escaping the tank. The single refrigeration unit simultaneously provides low-temperature refrigerant to the secondary solvent condenser and the primary solvent condenser in a first mode. The single refrigeration unit simultaneously provides low-temperature refrigerant to the primary solvent condenser and hi-temperature refrigerant to the secondary solvent condenser in a second mode.

13 Claims, 3 Drawing Sheets

REFRIGERATED VAPOR DEGREASING SYSTEM

FIELD OF THE INVENTION

The present invention relates to a chemical solvent, vapor degreasing system having a primary solvent condenser, a secondary solvent condenser, and a single refrigeration unit which provides cooling fluid to both condensers in a first mode, and provides cooling fluid to the primary condensor and defrosting fluid to the secondary solvent condensor in a second mode.

BACKGROUND OF THE INVENTION

Vapor degreasing is a well-known, simple and effective method of cleaning workpieces. Chemical-solvent vapor degreasing systems typically comprise an open-topped tank designed to contain a bath of chemical degreasing or cleaning solvent. Heating coils are mounted on or adjacent to the bottom of the tank and are immersed within the solvent. The heating coils boil the solvent and generate vapors which condense on the workpieces, thereby dissolving oil and grease and removing other contaminants from the workpieces.

To prevent the environmentally-deleterious, chemical degreasing solvent from escaping the tank through the open top, it is known to provide a primary solvent condenser positioned intermediate the tank, and a freeboard chiller or secondary solvent condenser positioned above the primary solvent condensor proximate the open top of the tank. The primary and secondary condensors typically comprise a series of low-temperature, finned refrigeration coils located on the inner walls of the tank. Low-temperature refrigerant flows through the coils to create primary and secondary barriers which inhibit the loss of evaporated degreasing solvent.

The temperature of the refrigerant circulating through the freeboard chiller is typically less than 0° F. Therefore, the condensing coils of the freeboard chiller must be defrosted periodically to maintain their efficiency. To defrost the freeboard chiller, the flow of low-temperature refrigerant to the freeboard chiller must be temporarily interrupted by turning off the refrigeration unit. If a single refrigeration unit is used to cool both the freeboard chiller and the primary solvent condensor, the degreasing operation must be shut down during the defrosting cycle since both condensers will be deactivated when the refrigeration unit is turned off. If the degreasing operation is not shut down, the vaporized degreasing solvent will freely escape the tank.

To eliminate this "down-time", it is known to provide two separate refrigeration units for cooling the freeboard chiller and the primary solvent condensor. With two separate refrigeration units, the freeboard chiller can be defrosted without deactivating the primary solvent condensor. Therefore, the degreasing operation can be continued during the defrost cycle, albeit with a small loss of vaporized solvent from the top of the tank. However, a degreasing system having dual refrigeration units is more costly and is less efficient than a system having a single refrigeration unit.

Therefore, it would be desirable to provide a refrigerated vapor degreasing system which requires only one refrigeration unit for cooling both the freeboard chiller and the primary solvent condenser.

Additionally, it would be desirable to provide a degreasing system with single refrigeration unit wherein the freeboard chiller can be defrosted while still maintaining the flow of low-temperature refrigerant through the primary solvent condenser.

SUMMARY OF THE INVENTION

The present invention relates to a refrigerated vapor degreasing system which requires only one refrigeration unit for cooling both the freeboard chiller and the primary solvent condensor. Further, the degreasing system of the present invention has a single refrigeration unit which operates in two different modes so that the freeboard chiller can be defrosted while still maintaining the flow of low-temperature refrigerant through the primary solvent condenser. In the first mode, the refrigeration unit provides cooling fluid to both solvent condensers. In the second mode, the refrigeration unit provides cooling fluid to the primary solvent condenser and defrosting fluid to the secondary solvent condensor.

The degreasing system comprises a tank which is constructed and arranged for containing a bath of degreasing solvent. The tank preferably has an open top construction for easily accessing the inside of said tank. The tank has submersible heating elements at the bottom for vaporizing the solvent.

A primary solvent condensor is fixed in the tank above the solvent bath. The primary solvent condensor creates a degreasing zone above the solvent bath and around workpieces which are supported therein. The primary solvent condensor also creates a primary barrier preventing the vaporized solvent from escaping the tank. The primary solvent condensor preferably comprises low-temperature, finned refrigeration coils located on the inner walls of the tank intermediate the secondary solvent condensor and the solvent bath.

A secondary solvent condensor is fixed in the tank above the primary solvent condenser. The secondary solvent condensor creates a cold air blanket above the degreasing zone which acts as a secondary barrier preventing the vaporized solvent from escaping the tank. The secondary solvent condensor preferably comprises low-temperature, finned refrigeration coils located on the inner walls of the tank proximate the top of the tank.

A single refrigeration unit is provided which can be switched to operate in two different modes. The refrigeration unit is constructed and arranged to provide: a flow of low-temperature refrigerant to the secondary solvent condensor; a flow of low-temperature refrigerant to the primary solvent condensor; and, intermittent flow of high-temperature refrigerant to the secondary solvent condenser. The single refrigeration unit simultaneously provides low-temperature refrigerant to the secondary solvent condensor and the primary solvent condenser in the first mode; and, simultaneously provides low-temperature refrigerant to the primary solvent condensor and high-temperature refrigerant to the secondary solvent condensor in the second mode.

The single refrigeration unit is constructed and arranged to cycle refrigerant in a closed-loop system as low-pressure/low-temperature vapor, high-pressure/high-temperature vapor, high-pressure/low-temperature liquid, low-pressure/low-temperature vapor, and low-pressure/high-temperature liquid. The single refrigeration unit is arranged in fluid connection with the secondary solvent condensor and the primary solvent condenser.

The refrigeration unit has a single compressor having a low-pressure/low-temperature input and high-pressure/high-temperature output, and a refrigerant condensor having a high-pressure/high-temperature input and a high-pressure/ low-temperature output. A hot gas metering valve is positioned intermediate the compressor and the refrigerant condenser. The hot gas metering valve connects the high-pressure/high-temperature output of the compressor directly to the secondary solvent condensor. A first liquid metering valve connects the high-pressure/low-temperature output of the refrigerant condensor to the secondary solvent condenser. A second liquid metering valve connects the high-pressure/low-temperature output of the refrigerant condenser to the primary solvent condensor.

The vapor degreasing system includes a controller connected to and selectively operating the hot gas metering valve, the first liquid metering valve, and the second liquid metering valve. The controller selectively opens and closes the hot gas metering valve, and the first and second liquid metering valves so that: in the first mode, the hot gas metering valve is closed and the first and second liquid metering valves are open; and, in the second mode, the hot gas metering valve and the second liquid metering valve are open, and the first liquid metering valve is closed. The metering valves may include solenoid valves.

In a preferred embodiment, the low-temperature refrigerant circulating to the secondary solvent condensor has a temperature in the range of −0° to −40° F., and the low-temperature refrigerant circulating to the primary solvent condensor has a temperature in the range of 0° to 40° F.

Preferably, the high-temperature refrigerant has a temperature in the range of 80° to 90° F.

The present invention further includes a method of vapor degreasing workpieces. The method comprises supporting the workpieces in a tank; evaporating a degreasing solvent in the tank; cycling refrigerant in a close-loop, single compressor refrigeration system as low-pressure/low-temperature vapor, high-pressure/high-temperature vapor, high-pressure/low-temperature liquid, low-pressure/low-temperature vapor, and low-pressure/low-temperature liquid; forming a degreasing zone around the workpieces and a primary evaporation barrier above the workpieces by circulating low-pressure/low-temperature refrigerant from the refrigeration system through a primary solvent condensor located above the workpieces; forming a secondary evaporation barrier above the degreasing zone by circulating low-pressure/low-temperature refrigerant from the refrigeration system through a secondary solvent condensor located above the degreasing zone; and, intermittently defrosting the secondary solvent condensor by circulating high-pressure/high-temperature refrigerant from the refrigeration unit through the secondary solvent condenser.

The degreasing zone is formed by condensing vaporized solvent on the workpieces and the primary solvent condensor, both of which have a temperature less than the vaporized solvent. The secondary evaporation barrier is formed by circulating refrigerant through the secondary solvent condensor at a temperature less than the temperature of the refrigerant circulating through the primary solvent condenser.

The secondary solvent condensor is defrosted by temporarily restricting the flow of low-pressure/low-temperature refrigerant through the secondary solvent condenser, and circulating high-pressure/high-temperature refrigerant through the secondary solvent condenser.

A series of metering valves in the refrigeration system is selectively opened and closed so that: in a first mode, low-pressure/low-temperature refrigerant flows through the primary solvent condenser and the secondary solvent condensor; and, in a second mode, low-pressure/low-temperature liquid refrigerant flows through the primary solvent condenser and high-pressure/high-temperature vapor refrigerant flows through the secondary solvent condensor. The metering vales are opened and closed by calibrating the metering valves and opening or closing respective serially-aligned solenoid valves.

DESCRIPTION OF PREFERRED EMBODIMENTS OF THE INVENTION

Figure 1:
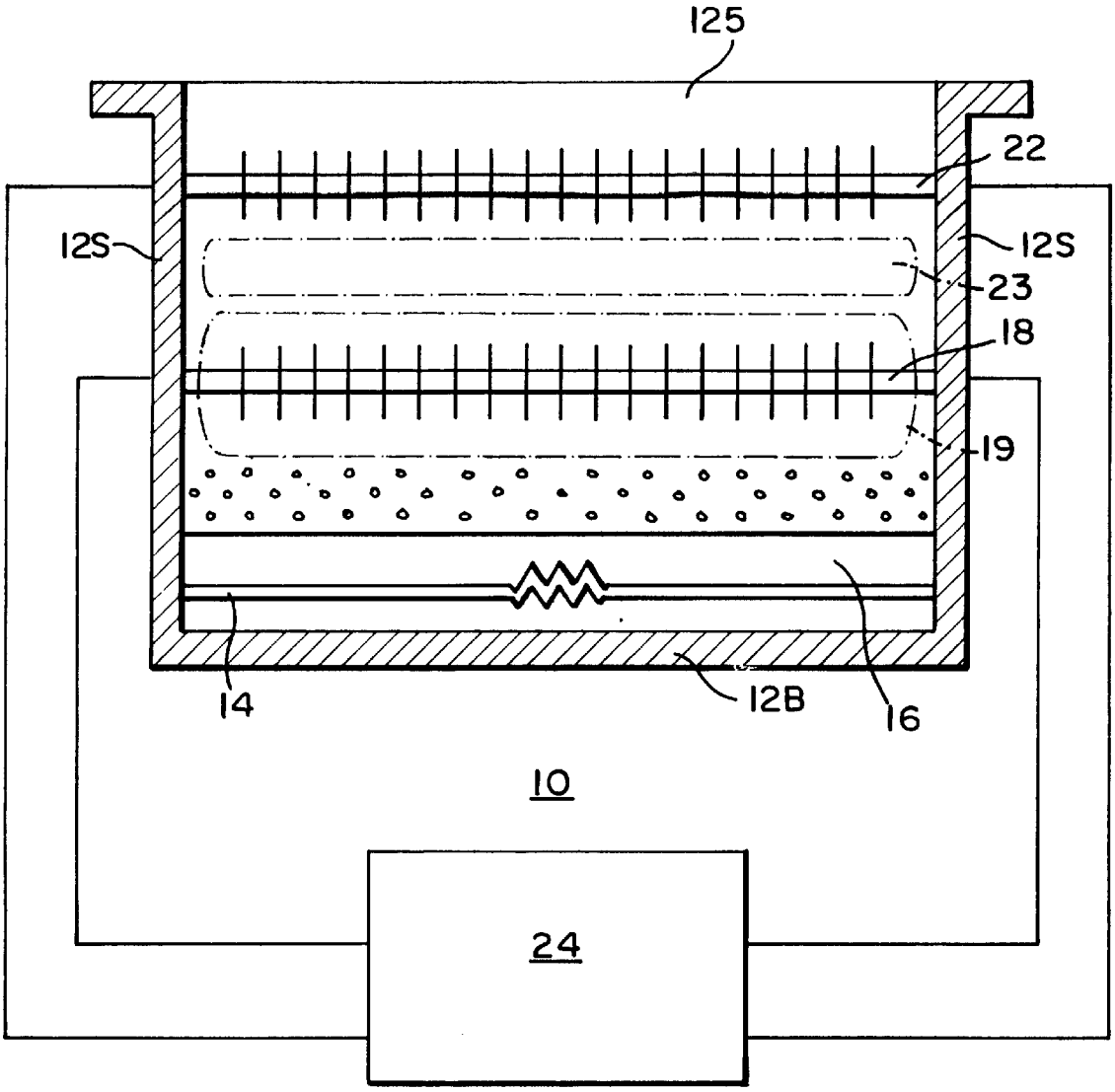
FIG. 1 is a schematic illustration of a vapor degreasing system in accordance with an embodiment of the invention.
Figure 2:
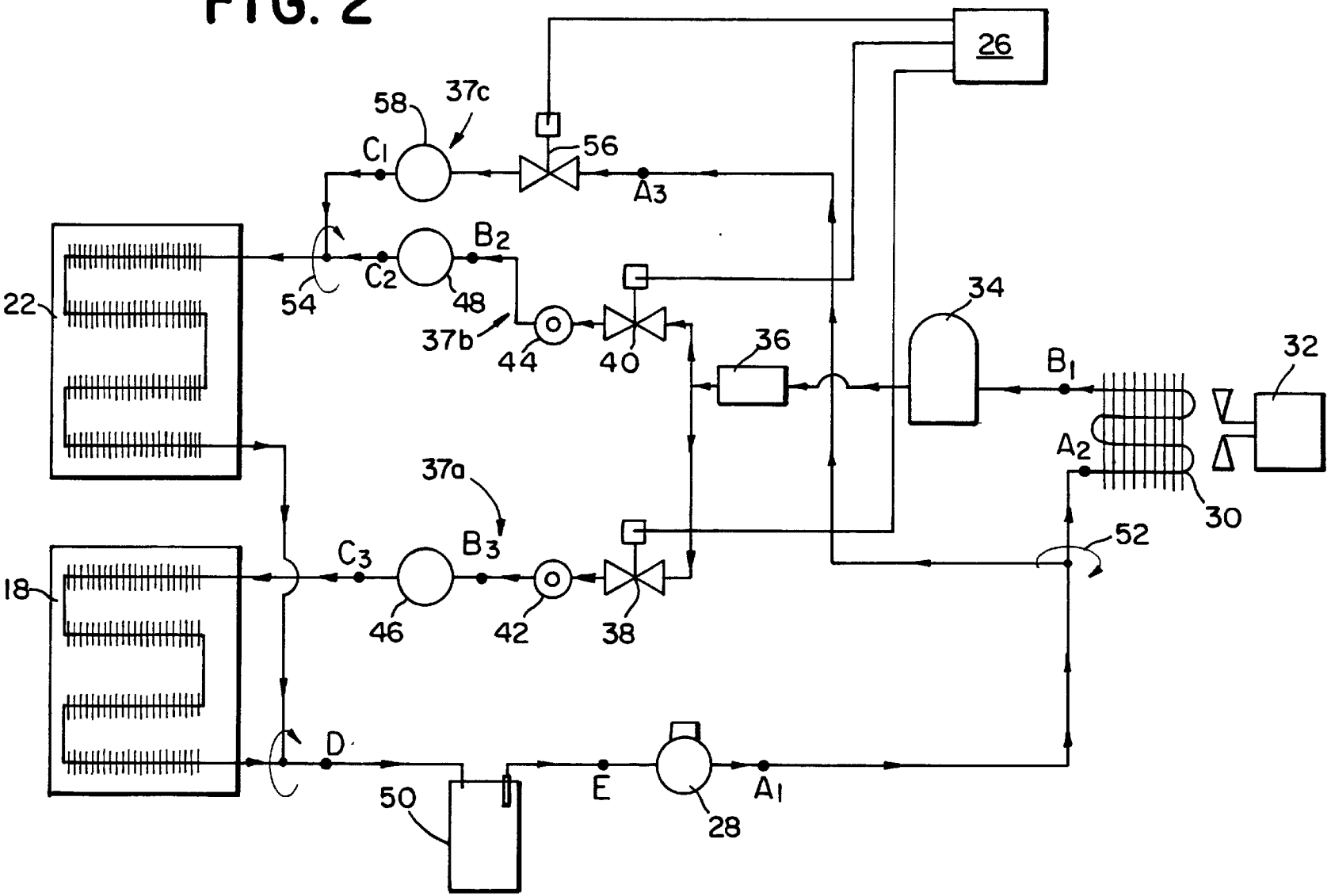
FIG. 2 is a detailed schematic illustration of the refrigeration unit of FIG. 1; and, FIG. 3 is a detailed schematic illustration of the controller of FIG. 2.
Figure 3:
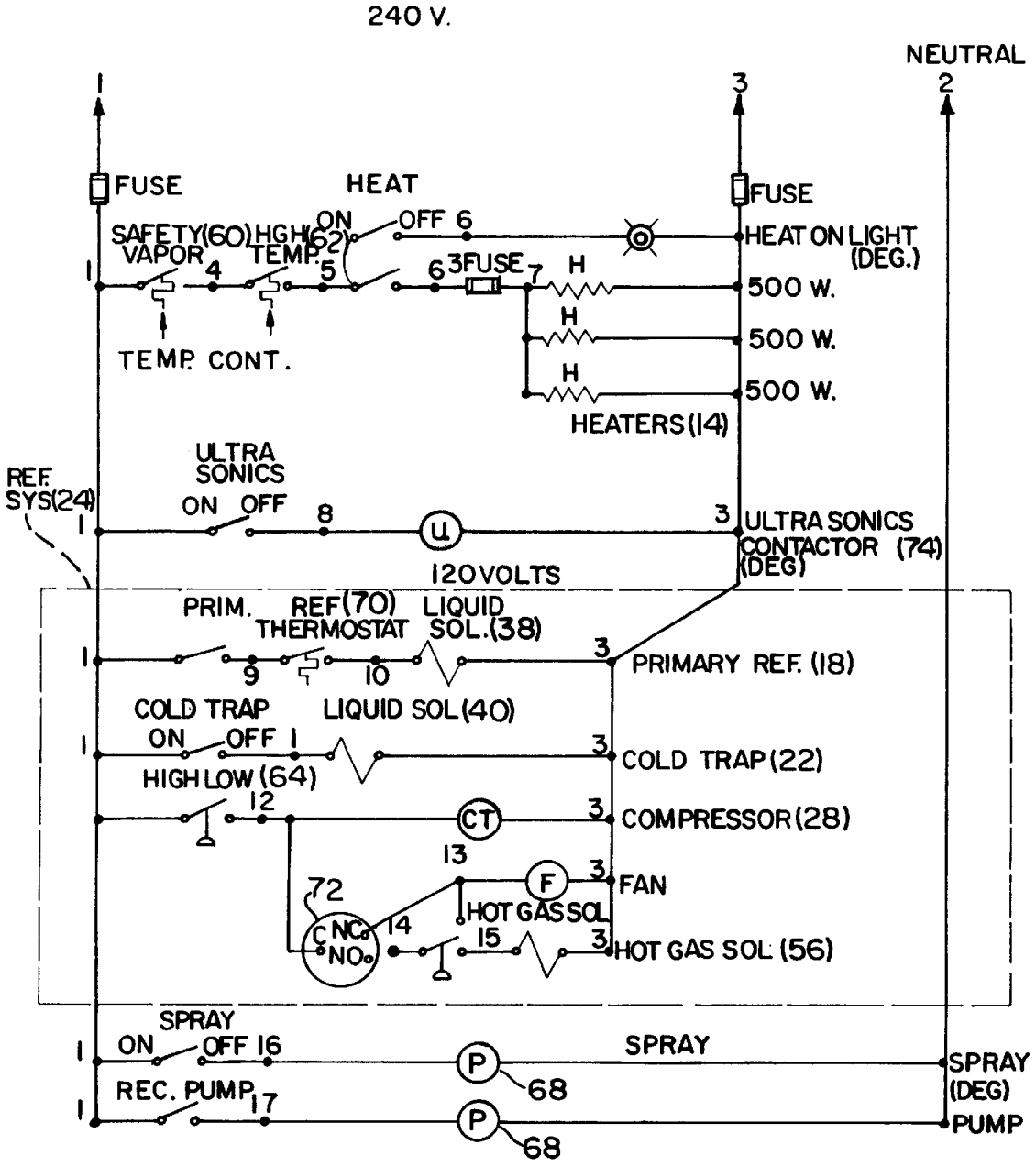

The novel vapor degreasing system of the present invention is described herein with respect of FIGS. 1–3 wherein like reference numerals are used therein to designate similar components of the invention.

The refrigerated vapor degreasing system of the present invention is illustrated schematically in FIG. 1 and designated generally by reference numeral 10. The vapor degreasing system comprises a tank 12 designed to contain a bath of chemical degreasing solvent 16 and support workpieces therein for cleaning. The tank 12 is generally rectangular and has a bottom wall 12*b* and four vertically-extending sidewalls 12*s*.For illustrative purposes, one of the sidewalls (the front wall) is removed in FIG. 1. The tank 12 preferably has an open-top construction so that workpieces may be easily loaded into and unloaded from the tank 12. Alternatively, the tank 12 may have a top wall with a suitably-sized opening.

The degreasing solvent 16 can be any of the common chlorinated or fluorocarbon solvents commercially available for degreasing including, but not limited to, trichloroethylene, perchloroethylene, methylene chloride, 3-M's HFE line, DuPont's Vertral line, and AK-225. The vaporized degreasing solvent 16 condenses on the lower-temperature workpieces and removes grease, oil and other contaminants on the workpieces.

Heating elements 14 are fixed inside the tank 12 on or proximate the bottom wall 12*b*. The heating elements 14 are designed to be immersed in the chemical degreasing solvent 16 and raise the temperature of the solvent to its boiling point so that the solvent evaporates in the tank. The heating elements 14 may be either steam or electrically heated. In a preferred embodiment, the heaters are Chromalox OT-1205 500W, 240V strip heaters.

A primary solvent condensor 18 is fixed intermediate the tank 12 above the solvent bath 16. The primary solvent condensor 18 creates a degreasing zone 19 (depicted in phantom lines) above the solvent bath 16 and around the workpieces, and also creates a primary barrier preventing the vaporized solvent from escaping the tank. Preferably, the primary solvent condensor 18 comprises, low-temperature, finned refrigeration coils fixed to and extending along the inner walls of the tank 12. Evaporated degreasing solvent, which does not condense on the workpieces, condenses in the degreasing zone 19 and is recycled back into the solvent bath 16 for further use.

The primary solvent condenser is arranged in fluid connection with a refrigeration unit 24 which circulates low-temperature refrigerant through the primary condensor 18. The refrigerant circulating through the primary condensor preferably has a temperature in the range of 0° F.–40° F.

A deck (not shown) for supporting the workpieces is supported by the inner walls of the tank intermediate the primary solvent condensor and the solvent bath. The support deck is preferably perforated so that evaporated solvent may pass therethrough and condense on the workpieces.

A secondary solvent condensor 22 is fixed in the tank above the primary solvent condensor 18, preferably proximate the top of the tank 12. The secondary solvent condenser 22 creates a cold air blanket 23 (shown in phantom lines) above the degreasing zone 19 which acts as a secondary barrier preventing the vaporized solvent from escaping the tank 12. Preferably the secondary solvent condensor 22 comprises low-temperature, finned refrigeration coils, fixed to and extending around the inner walls of the tank. Evaporated degreasing solvent which escapes the primary barrier condenses in the cold air blanket formed by the secondary solvent condensor 22, and is recycled back into the solvent bath 16 for further use. The above-described secondary solvent condensor 22 is known in the art as a freeboard chiller.

The secondary solvent condenser 22 is arranged in fluid connection with the refrigeration unit 24 which circulates low-temperature refrigerant through the secondary solvent condenser 22 in a first or refrigeration mode, and high-temperature refrigerant through the secondary solvent condensor 22 in a second or defrosting mode. The low-temperature refrigerant circulating through the secondary solvent condensor 22 preferably has a temperature in the range of −40° to 0° F., while the high-temperature refrigerant which intermittently flows therethrough has a temperature in the range of 80° to 90° F.

The degreasing system 10 includes a single, two-mode refrigeration unit 24 which provides a flow of low-temperature (0° to 40° F.) refrigerant to the primary solvent condenser 18, and alternately provides low-temperature (−40° to 0° F.) refrigerant and high-temperature (80° to 90° F.) refrigerant to the secondary solvent condensor 22. In the first or refrigeration mode, the single refrigeration unit 24 simultaneously provides low-temperature refrigerant to the primary solvent condensor 18 and to the secondary solvent condensor 22. In the second or defrosting mode, the single refrigeration unit simultaneously provides low-temperature refrigerant to the primary solvent condensor 18 and high-temperature refrigerant to the secondary solvent condenser 22. The single refrigeration unit 24 can be switched between modes either manually or automatically with a timed-controller 26. The refrigeration unit 24 is illustrated generally in FIG. 1 and in schematic detail in FIG. 2.

A controller 26 is schematically illustrated in FIG. 3 wherein the following commercially available parts are used: Penn Johnson A19ADC-31C safety vapor control (60); Penn Johnson A19ADC-31C high temperature control (62); Penn Johnson P70MAI high low pressure switch (64); Penn Johnson P70GA-2C defrost pressure control (66); Little Giant MD-SC centrifugal pump (68); Penn Johnson A19AAF21C refrigeration thermostat (70); Graslin FM2h timer (72); Ultrasonic-Power 50-32-153ultrasonic (74); Danfoss EVR-10 hot gas solenoid (56); and, Danfoss EVR-10 liquid line solenoids (38,40)

The refrigeration unit 24 comprises a closed-loop system in which refrigerant, such as R507, is cycled in a standard refrigeration cycle. Other types of refrigerants which may be used include, but are not limited to R502, R22, R12, R404A, and AZ22. Referring to FIG. 2, the refrigerant is cycled as high-pressure/high-temperature vapor at points A1, A2, and A3; high-pressure/low-temperature liquid at points B1, B2, and B3; low-pressure/low-temperature vapor at points C1, C2, and C3; low-pressure/high-temperature liquid at point D; and, low-pressure/high-temperature vapor at point E. The terms low and high are used to describe the temperature or pressure of the refrigerant relative to the refrigerant's previous state in the cycle. The absolute quantities of the temperature and pressure of the refrigerant at each state in the refrigeration cycle are described below.

In FIG. 2, flow lines with arrows represent fluid connections between the components whereas flow lines without arrows represent electrical connections between components. The refrigeration unit 24 is designed to be switched by the controller 26 between the refrigeration mode and the defrosting mode.

The refrigeration unit includes a compressor 28 having a low-pressure/low-temperature refrigerant input and a high-pressure/high-temperature refrigerant output. In the embodiment illustrated in FIG. 2, the compressor 28 comprises a ¾ h.p. unit which generates about 9,000 BTU's at high temperature and about 4,500 BTU's at low temperature such as available from Copeland part no. KAJA-011E-TAC-100.

A condensor 30 is arranged in serial, fluid connection with the output of the compressor 28. The condensor 30 cools the high-pressure/high-temperature refrigerant by circulating the refrigerant through coils which are cooled by a fan 32. A preferred condensor is made by Copeland, part no. 066 0305-00.

A receiver 34 is arranged in serial, fluid connection with the output of the condensor 30. The receiver 34 stores liquid refrigerant during shut down. A preferred receiver is made by Shelby, part no. 577 0315-02.

A liquid line dryer 36 is arranged in serial, fluid connection with the output of the receiver 34. The liquid line dryer removes water from the high-pressure/low-temperature liquid exiting the condenser 30. A preferred liquid line dryer is made by Danfoss, part no. DX 083.

Two separate solvent condensor circuits 37*a,* 37*b*are arranged in parallel, fluid connection with the output of the liquid line dryer 36. The first circuit 37*a* connects the output of the liquid line dryer 36 to the primary solvent condensor 18. The second circuit 37*b* connects the output of the liquid line dryer 36 to the secondary solvent condenser 22. Each circuit has a solenoid valve, site glass, and liquid metering valve arranged in serial, fluid connection intermediate the liquid line dryer 36 and the solvent condensor 18 or 22. The solenoid valves 38, 40 are electrically connected to the controller 26 and are operable between open and closed positions to regulate the flow of refrigerant through the first circuit 37*a* and the second circuit 37*b,* respectively.

The site glasses 42, 44 enable the operator to monitor the state of the refrigerant flowing through each of the circuits 37*a,* 37*b.* A preferred site glass is made Danfoss, part no. 014-0064.

The liquid metering valves 46, 48 control the volumetric flow and expansion of the refrigerant circulating to the respective solvent condensers. Preferably, the metering valves 46, 48 comprise a liquid expansion valve calibrated to vaporize the high-pressure/low-temperature liquid refrigerant passing therethrough. A preferred primary metering valve 46 is made by Sporland, part no. SRE 1/4 C. A preferred secondary metering valve 48 is made by Sporland, part no. SRE 1/4 C. A preferred secondary metering valve 48 is made by Sporland, part no. SRE 1/4 ZP.

The primary solvent condensor 18 is arranged in serial, fluid connection with the output of the metering valve 46 in the first circuit 37*a.* The secondary solvent condenser 22 is arranged in serial, fluid connection with the output of the metering valve 48 in the second circuit 37*b*.

A common accumulator 50 is arranged in serial, fluid connection with the output of each of the solvent condensers. The accumulator 50 collects the condensed low-pressure/low-temperature liquid refrigerant which exits the solvent condensors 18, 22 and supplies low-pressure/low-temperature vapor refrigerant to the compressor 28. A preferred accumulator is made by Refrigeration Research, part no. 3738. In the refrigeration mode, refrigerant is continuously cycled in the above-described closed-loop system.

The refrigeration unit 24 includes a by-pass circuit 37*c* between the high-pressure/high-temperature output of the compressor 28 and the input to the secondary solvent condenser 22. Referring to FIG. 2, a third fluid circuit 37*c* branches off the high-pressure/high-temperature portion of the closed-loop system via a first "T" connection 52 and circulates back into the closed-loop system at the low-pressure/low-temperature vapor portion of the closed-loop system via a second "T" connector 54. The by-pass circuit 37*c* has a third solenoid valve 56 and a hot gas metering device 58 arranged in serial, fluid connection intermediate the compressor 28 and the secondary solvent condenser 22. The third solenoid valve 56 is also electrically connected to the controller 26. Preferably, the hot gas device 58 comprises a needle valve such as made by, for example, Swagelok Company, part no. W-1287-4 3/8 brass.

The by-pass circuit 37*c* is only open in the defrosting mode. When open, the by-pass circuit 37*c* allows high-pressure/high-temperature vapor refrigerant to circulate through the secondary solvent condenser 22, thereby defrosting any frozen degreasing solvent which may have accumulated thereon.

In the refrigeration mode, refrigerant is continuously cycled through the compressor 28, condensor 30, receiver 34, dryer 36, and then through the first 37*a* and second 37*b* solvent condensor circuits, thereby providing low-pressure/low-temperature vapor refrigerant to the primary solvent condensor 18 and secondary solvent condenser 22, respectively. In the refrigeration mode, the by-pass circuit 37*c* is closed by closing the third solenoid valve 56. Thus, in the refrigeration mode, a standard refrigeration cycle is maintained through both the primary solvent condensor 18 and the secondary solvent condenser 22.

In the defrosting mode, the by-pass circuit 37*c* is open by opening the third solenoid valve 56 and the second solvent condensor circuit 37*b* is closed by closing the second solenoid valve 40. The refrigerant exiting the compressor 28 is divided between two separate refrigerant flow paths. In the first path, refrigerant circulates through the condensor 30, receiver 34, dryer 36, first circuit 37*a,* and through the primary solvent condenser 18. In the second path, refrigerant circulates from the compressor through the by-pass circuit 37*c,* and through the secondary solvent condensor 22. Thus, in the defrost mode, a standard refrigeration cycle is maintained in the primary solvent condenser 18 while a defrosting cycle is maintained in the secondary solvent condensor 22.

The controller 26 selectively operates, i.e., opens and closes, the solenoid valves so that: in the refrigeration mode, the solenoid valve 56 in the by-pass circuit 37*c* is closed and the solenoid valves 46, 48 in the parallel solvent condensor circuits 37*a* and 37*b* are open; and, in the defrosting mode, the solenoid valve 56 in the by-pass circuit 37*c* and the solenoid valve 38 in the first solvent condensor circuit 37*a* are open, and the solenoid valve 40 in the second solvent condensor circuit 37*b* is closed.

The flow of refrigerant through the first 37*a,*second 37*b* and third 37*c* circuits is controlled by the metering devices 46, 48, 58, respectively. The hot gas metering device 58 preferably comprises a needle valve which can be adjusted so that sufficient vaporized refrigerant circulates through the by-pass circuit to defrost the secondary solvent condensor in about 1–4minutes. However, the hot gas metering device 58 must sufficiently restrict the flow of refrigerant through the by-pass circuit 37*c* so that too much refrigerant is not diverted from the primary cooling portion of the closed-loop system.

In an alternative embodiment, the second liquid metering device 48 may comprise a maximum operating pressure (MOP) limiting valve having a low pressure (such as 30 p.s.i.) setting. In this embodiment, the second solenoid valve 40 need not be closed in the defrost mode since the pressure differential at the MOP valve automatically prevents refrigerant from flowing through the second solvent condenser circuit 37*b*.

EXAMPLE

The size and capacity of the above-described refrigeration unit components, including the total capacity of the refrigeration unit, will depend on the size and capacity of the degreasing system with which the refrigeration unit 24 is connected. By way of example, the following system parameters are preferred for a degreasing system designed to clean 10 workpiece loads per hour, each load weighing approximately 50 pounds. In this example, the primary refrigeration unit is sized to remove 5,200 B.T.U./hr which is induced by the heating elements.

TABLE 1

| | Refrigeration Mode | | Defrost Mode | |
|---|---|---|---|---|
| Output | Pressure (p.s.i.) | Temperature (°F.) | Pressure (p.s.i.) | Temperature (°F.) |
| Compressor | 200 | 87 | 125 | 58 |
| Condensor | 200 | 87 | 125 | 58 |
| 1st Liquid metering valve | 35–89 | 0–40 | 35–89 | 0–40 |
| 2nd Liquid metering valve | 35–5.5 | 0–(−40) | — | — |
| Vapor meterting valve | — | — | 125 | 58 |
| Primary solvent condensor | 35–89 | 0–40 | 125 | 58 |
| Secondary solvent condensor | 35–5.5 | 0–(−40) | 125 | 58 |

By balancing the above-listed parameters, it is possible to utilize a single refrigeration unit for the refrigeration mode and the defrosting mode of the degreasing system.

I claim:

1. Refrigerated vapor degreasing system for cleaning workpieces comprising:

*a*) a tank constructed and arranged for containing a bath of degreasing solvent;

*b*) a heater for vaporizing the solvent;

*c*) a primary solvent condensor fixed in said tank above the solvent bath, said solvent condensor creating a degreasing zone above the solvent bath and around workpieces supported therein, and creating a primary barrier preventing the vaporized solvent from escaping the tank;

*d*) a secondary solvent condensor fixed in said tank above said primary solvent condensor, said secondary solvent condensor creating a cold air blanket above the degreasing zone which acts as a secondary barrier preventing the vaporized solvent from escaping the tank;

*e*) a single refrigeration unit which can be switched to operate in two different modes and is constructed and arranged to provide a flow of:

*i*) low-temperature refrigerant to said secondary solvent condensor;

*ii*) low-temperature refrigerant to said primary solvent condensor; and,

*iii*) high-temperature refrigerant to said secondary solvent condenser, said single refrigeration unit simultaneously providing low-temperature refrigerant to said secondary solvent condensor and said primary solvent condensor in the first mode, and simultaneously providing low-temperature refrigerant to said primary solvent condensor and high-temperature refrigerant to said secondary solvent condensor in the second mode.

2. The vapor degreasing system recited in claim 1, said tank having an open top construction for easily accessing the inside of said tank.

3. The vapor degreasing system recited in claim 1, said secondary solvent condensor comprising low-temperature, finned refrigeration coils located on the inner walls of said tank proximate the top of said tank.

4. The vapor degreasing system recited in claim 1, said primary solvent condensor comprising low-temperature, finned refrigeration coils located on the inner walls of said tank intermediate said secondary solvent condensor and the solvent bath.

5. The vapor degreasing system recited in claim 1, said single refrigeration unit constructed and arranged to cycle refrigerant in a closed-loop system as low- pressure/low-temperature vapor, high-pressure/high-temperature vapor, high-pressure/low-temperature liquid, and low-pressure/low-temperature vapor, and low-pressure/high-temperature liquid.

6. The vapor degreasing system recited in claim 5, said single refrigeration unit constructed and arranged in fluid connection with said secondary solvent condensor and said primary solvent condenser, said refrigeration unit comprising:

*a*) a single compressor having a low-pressure/low-temperature input and high-pressure/high-temperature output;

*b*) a refrigerant condensor having a high-pressure/high-temperature input and a high-pressure/low-temperature output;

*c*) vapor metering valve intermediate said compressor and said refrigerant condenser, said vapor metering valve connecting the high-pressure/high-temperature output of the compressor to said secondary solvent condensor;

*d*) first liquid metering valve connecting the high-pressure/low-temperature output of said refrigerant condensor to said secondary solvent condensor; and

*e*) second liquid metering valve connecting the high-pressure/low-temperature output of said refrigerant condensor to said primary solvent condensor.

7. The vapor degreasing system recited in claim 6, including a controller connected to and selectively operating said vapor metering valve, said first liquid metering valve, and said second liquid metering valve.

8. The vapor degreasing system recited in claim 7, said controller selectively opening and closing said vapor metering valve, and said first and second liquid metering valves so that:

*a*) in a first mode, said vapor metering valve is closed and said first and second liquid metering valves are open; and

*b*) in a second mode, said vapor metering valve and said second liquid metering valve are open, and said first liquid metering valve is closed.

9. The vapor degreasing system recited in claim 8, said metering valves including solenoid valves.

10. The vapor degreasing system recited in claim 1, said low-temperature refrigerant to said secondary solvent condensor having a temperature in the range of −20° to −40° F.

11. The vapor degreasing system recited in claim 1, said low-temperature refrigerant to said primary solvent condensor having a temperature in the range of 0° to 40° F.

12. The vapor degreasing system recited in claim 1, said high-temperature refrigerant having a temperature in the range of 80° to 90° F.

13. Refrigerated vapor degreasing system for cleaning workpieces comprising:

*a*) a tank constructed and arranged for containing a bath of degreasing solvent;

*b*) a heater for vaporizing the solvent;

*c*) a primary solvent condenser fixed in said tank above the solvent bath, said primary solvent condensor creating a degreasing zone above the solvent bath and around workpieces supported therein, and creating a primary barrier preventing the vaporized solvent from escaping the tank;

*d*) a secondary solvent condensor fixed in said tank above said primary solvent condensor, said secondary solvent condenser creating a cold air blanket above the degreasing zone which acts as a secondary barrier preventing the vaporized solvent from escaping the tank; and

*e*) a single refrigeration unit which can be switched to operate in two different modes and is constructed and arranged to provide a flow of;

*i*) low-temperature refrigerant to said secondary solvent condenser;

*ii*) low-temperature refrigerant to said primary solvent condensor; and

*iii*) high-temperature refrigerant to said secondary solvent condenser, said single refrigeration unit simultaneously providing low-temperature refrigerant to said secondary solvent condensor and said primary solvent condensor in a first mode, and simultaneously providing low-temperature refrigerant to said primary solvent condensor and high-temperature refrigerant to said secondary solvent condensor in a second mode, said tank having an open top construction for easily accessing the inside of said tank, said secondary solvent condensor comprising low-temperature, finned refrigeration coils located on the inner walls of said tank proximate the top of said tank, said primary solvent condensor comprising low-temperature, finned refrigeration coils located on the inner walls of said tank intermediate said secondary solvent condensor and said solvent bath, said single refrigeration unit constructed and arranged to cycle refrigerant in a closed-loop system as low-pressure/low-temperature vapor, high-pressure/high-temperature vapor, high-pressure/low-temperature liquid, low-pressure/low-temperature vapor, and low-pressure/high-temperature liquid, said single refrigeration unit constructed and arranged in fluid connection with said secondary solvent condensor and said primary solvent condenser, said refrigeration unit comprising:

*a*) a single compressor having a low-pressure/low-temperature input and high-pressure/high-temperature output;

*b*) a refrigerant condensor having a high-pressure/high-temperature input and a high-pressure/low-temperature output;

*c*) vapor metering valve intermediate said compressor and said refrigerant condenser, said vapor metering valve connecting the high-pressure/high-temperature output of the compressor to said secondary solvent condenser;

*d*) first liquid metering valve connecting the high-pressure/low-temperature output of said refrigerant condenser to said secondary solvent condensor; and

*e*) second liquid metering valve connecting the high-pressure/low-temperature output of said refrigerant condensor to said primary solvent condensor, including a controller connected to and selectively operating said vapor metering valve, said first liquid metering valve, and said second liquid metering valve, said controller selectively opening and closing said vapor metering valve, and said first and second liquid metering valves so that:

*a*) in said first mode, said vapor metering valve is closed and said first and second metering valves are open; and

*b*) in said second mode, said vapor metering valve and said second liquid metering valve are open, and said first liquid metering valve is closed, said metering valves including solenoid valves, said low-temperature refrigerant to said secondary solvent condensor having a temperature in the range of 0° to −40° F., said low-temperature refrigerant to said primary solvent condenser having a temperature in the range of 0° to 40° F., said high-temperature refrigerant having a temperature in the range of 80° to 90° F.

* * * * *